United States Patent [19]

Antonious

[11] Patent Number: 5,011,151

[45] Date of Patent: Apr. 30, 1991

[54] WEIGHT DISTRIBUTION FOR GOLF CLUB HEAD

[76] Inventor: Anthony J. Antonious, 205 E. Joppa Rd., Towson, Md. 21204

[21] Appl. No.: 403,494

[22] Filed: Sep. 6, 1989

[51] Int. Cl.[5] ..... A63B 53/04

[52] U.S. Cl. ..... 273/164; 273/167 H; 273/169; 273/167 F

[58] Field of Search ..... 273/167–175, 273/77 A, 193 R, 194 R, 77 R; D21/220

[56] References Cited

U.S. PATENT DOCUMENTS

| | | | |
|---|---|---|---|
| D. 164,469 | 9/1951 | Behrendt | 273/167 D X |
| D. 165,458 | 12/1951 | Jacobs | 273/169 X |
| 1,671,936 | 5/1928 | Sime | 273/167 A |
| 3,845,960 | 11/1974 | Thompson | 273/171 |
| 4,211,416 | 7/1980 | Swanson | 273/164 |
| 4,340,230 | 7/1982 | Churchward | 273/171 |
| 4,345,763 | 8/1982 | Swanson | 273/167 J X |
| 4,444,392 | 4/1984 | Duclos | 273/167 E X |
| 4,621,813 | 11/1986 | Solheim | 273/169 X |
| 4,653,756 | 3/1987 | Sato | 273/167 E |
| 4,715,601 | 12/1987 | Lamanna | 273/169 X |
| 4,826,172 | 5/1989 | Antonious | 273/169 |

FOREIGN PATENT DOCUMENTS

| | | | |
|---|---|---|---|
| 211781 | 12/1957 | Australia | 273/169 |
| 29603 | of 1914 | United Kingdom | 273/169 |

OTHER PUBLICATIONS

"Golf Digest" Magazine, Feb. 1988 Issue, p. 51, Aug. 1979 Issue, p. 25.

*Primary Examiner*—Edward M. Coven
*Assistant Examiner*—Sebastiano Passaniti
*Attorney, Agent, or Firm*—N. J. Aquilino

[57] ABSTRACT

An iron type golf club head having a cavity back and peripheral weight including a toe counterweight formed on the outer periphery of the club at the toe and extending rearwardly from and below said top ridge and well above the sole of the club head, the toe counterweight forming the peripheral mass at the toe and having at least one quarter of its mass located above the longitudinal axis of the club head. A preferred embodiment of the club head includes an upper triangular counterweight along the top ridge and disposed principally toward the heel of the club head so that the mass at the toe and the mass at the heel serve to raise the club head's center of gravity while also counter-balancing each other.

8 Claims, 5 Drawing Sheets

WEIGHT DISTRIBUTION FOR GOLF CLUB HEAD

BACKGROUND OF THE INVENTION

Field of the Invention

The present invention relates to an iron type golf club head, and in particular to a perimeter weighted, cavity back iron type golf club head having an improved weight distribution.

Iron type golf club heads are used to hit a golf ball specific distances to specific targets. The lofts of conventional irons range from a minimum of about 16 degrees for a one iron to approximately 60 degrees for a wedge type club. Conventional cavity back type golf clubs include a peripheral mass around at least a portion of the club head, and this peripheral mass defines the central cavity at the back of the club head.

Conventional club heads now being marketed are forged full-back clubs or investment casting cavity-back clubs. Most, if not all, of these clubs have a high toe and a face which progressively increases in height from the heel portion to the toe portion of the club head. Those clubs also are predominantly weighted in the sole. As shown in both the conventional full back forged type club illustrated in FIGS. 1 and 2 and the conventional cavity-back club illustrated in FIGS. 3 and 4, the toe of conventional clubs has its greatest thickness, measured from the face of the club rearwardly, at the sole and progressively decreases in thickness as it extends upwardly. As a result, the center of gravity (CG) in such clubs is biased toward the sole of the club. Various weight distributions for club heads have been proposed in the past to maximize the energy transfer or the control of a golf ball when it is struck by the club head. For example, the U.S. Pat. No. to Solheim (4,621,813) discloses golf clubs in which the trailing edge of the sole of a peripheral weighted club is inclined toward the face. The U.S. Pat. No. to Johnstone (3,059,926) discloses a set of clubs in which the center of gravity (CG) is located progressively farther from the toe of the club head as the number of the club increases. The U.S. Pat. No. to Sime (1,671,956) discloses a golf club having decreased thickness in the middle of the blade and increased thicknesses at the toe and heel of the blade. The U.S. Pat. No. to Sato (4,653,756) discloses a club which is designed to include aerodynamic wings in the top and sole portions of the club. These and other attempts, in the inventor's opinion, have not provided the optimum weight distribution and club head design.

SUMMARY OF THE INVENTION

The present invention relates to an iron type golf club head with a unique configuration and construction which, in the preferred embodiment, includes a cavity back, peripheral weighted club head having a weighted mass added onto the peripheral mass on the back of the club head at the upper toe portion and substantially above the bottom surface of the club head. The mass preferably is shaped to flow freely into the peripheral mass, provides additional weight distribution adjacent the upper toe portion and moves the center of gravity (CG) upwardly from the sole and further toward the toe portion. In the preferred embodiment, the total club head weight is approximately the same as a standard club, and the mass and weight at the sole is decreased to offset the increased mass added to the upper toe. The resultant club head better accommodates golf balls which are struck toward the toe and provides maximum energy transfer when this occurs. The resultant club also has a higher center of gravity (CG) which provides improved performance.

In the preferred embodiment, the weighted mass located at the upper toe portion of the club head is counterbalanced by a weighted mass located at the top surface of the club head proximate the hosel and heel of the club head. These two masses add weight to the specific top portions of the club head and also better balance the weighting of the club head about its center of gravity (CG). Again, this additional mass at the top portion of the club head is offset by reducing mass at the sole of the club head. The added masses at the specific upper toe and upper heel portions of the club head are located at the outer perimeter of the club head. The mass at the sole similarly is positioned at the outer perimeter of the club. The preferred club head has a center of gravity (CG) that is higher on the club face than that of a standard club head.

Preferred embodiments of the invention also include a square toe design which provides a sighting and aligning portion along the top ridge to enable the player to more accurately align the club head toward the intended target line. The sighting and alignment portion is perpendicular to the intended line of flight and extends along the top ridge from a point in the middle of the club head to the toe portion. The sighting portion of the club head preferably is parallel to the club face grooves and has a height from the sole to the top ridge which is substantially the same along the entire length of sighting portion of the club head. The remaining portion of the top ridge angles upwardly from the hosel at the heel to approximately the middle point of the upper ridge where the sighting and alignment portion ends. The club head has added mass at the upper toe portion and preferably at the upper heel portion of the club, and less weight at the sole portion. The resultant club head has an improved weight distribution, a higher center of gravity (CG) and a significantly larger "sweet-spot" and cavity area than standard clubs.

Among the objects of the present invention are the provision of an iron type golf club head having improved weighting and ball striking characteristics including a relocated, substantial mass formed predominatly at the uppermost toe portion to maximize energy transfer and control.

Another object is to provide a club in which mass is relocated to the upper portion of the club proximate both the upper toe and the upper heel portions, to thereby raise the center of gravity of the club head and to provide a better balance to the club head about the center of gravity.

Another object is to provide a golf club head having an alignment and sighting means on the upper top ridge portion which permits mass to be relocated to other portions of the club head and which provides a club with a significantly larger "sweet-spot" and cavity area than that of conventional clubs.

Other objects and advantages of the invention will be set forth in the description which follows, and the accompanying drawings. This description and drawings serve to explain the broad principles of the invention.

To achieve the objects and in accordance with the purpose of the invention, as embodied and broadly described herein, the invention comprises a perimeter weighted iron type golf club head including a hosel, a heel portion, a toe portion, a striking face to hit a ball along an intended line of flight, a rear surface, a top ridge, a sole portion, a longitudinal axis bisecting the striking face, and a peripheral mass projecting rearwardly from the rear face and forming a cavity, wherein the improvement comprises a toe counterweight formed on the outer periphery of the club head at the toe portion and extending rearwardly from and below said top ridge and well above the sole portion, said toe counterweight forming the peripheral mass at the toe and having at least one third of its mass located above the longitudinal axis.

To achieve the objects and in accordance with the purpose of the invention, as embodied and broadly described herein, the invention further comprises an iron type golf club which includes a hosel, a heel portion, a toe portion, a striking face to hit a ball along an intended line of flight, a rear surface, a top ridge, a sole portion, a longitudinal axis bisecting the striking face, and a peripheral mass projecting rearwardly from the rear face and forming a cavity, the golf club head further comprising an upper counterweight in the form of a substantially triangular portion extending along the top ridge and into the hosel, the width and mass of said upper counterweight progressively increasing as it extends toward the heel portion and a toe counterweight formed between the top ridge and the sole portion at the outer periphery of the club head, the toe counterweight having a substantial mass located above the longitudinal axis of the club head and the uppermost portion of said toe counterweight extending immediately rearwardly from the club head's rear face.

It is to be understood, that both the foregoing general description and the following detailed description are exemplary and explanatory only and are not restrictive of the invention, as claimed.

The accompanying drawings, which are incorporated in and constitute a part of the specification, illustrate several embodiments of the invention and together with the description, serve to explain the principles of the invention.

DESCRIPTION OF PREFERRED EMBODIMENTS

Reference will now be made in detail to the present preferred embodiments of the invention, examples of which are illustrated in the accompanying drawings. Wherever possible, the same or similar reference numbers are used throughout the drawings to refer to the same or like parts.

Figure 1:
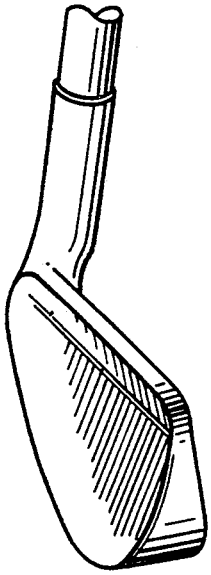
FIG. 1 (PRIOR ART)
FIG. 1 is a perspective view of a conventional full back club.
Figure 2:
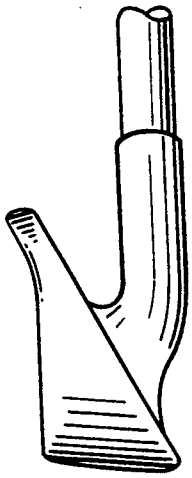
FIG. 2 (PRIOR ART)
FIG. 2 is an end view of the conventional full back club shown in FIG. 1.
Figure 3:
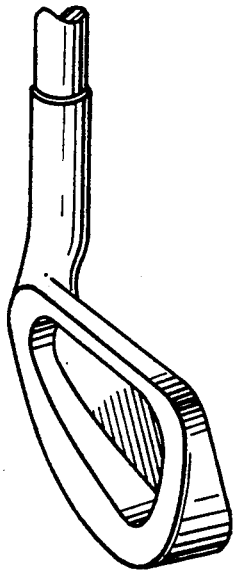
FIG. 3 (PRIOR ART)
FIG. 3 is a perspective view of a conventional perimeter weighted, cavity back club.
Figure 4:
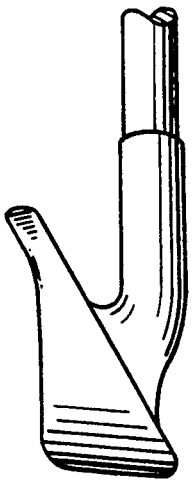
FIG. 4 (PRIOR ART)
FIG. 4 is an end view of the conventional perimeter weighted, cavity back club shown in FIG. 3.
Figure 5:
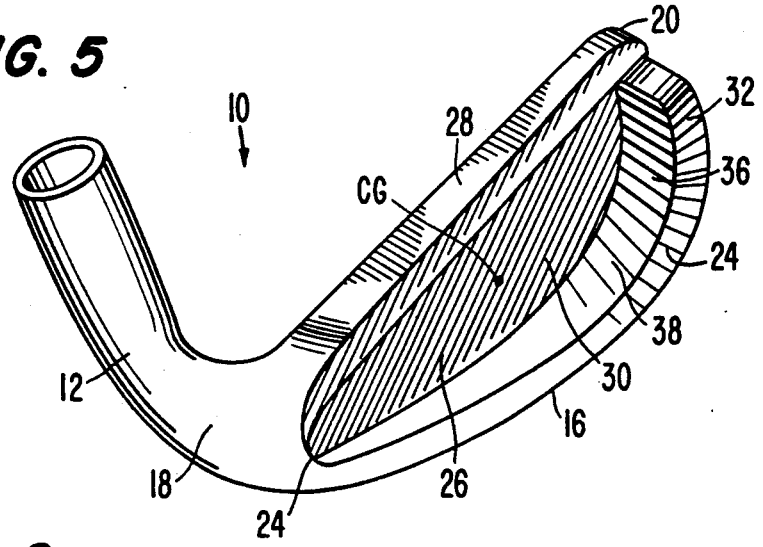
FIG. 5 is a rear perspective view of an iron type golf club head of the present invention.
Figure 6:
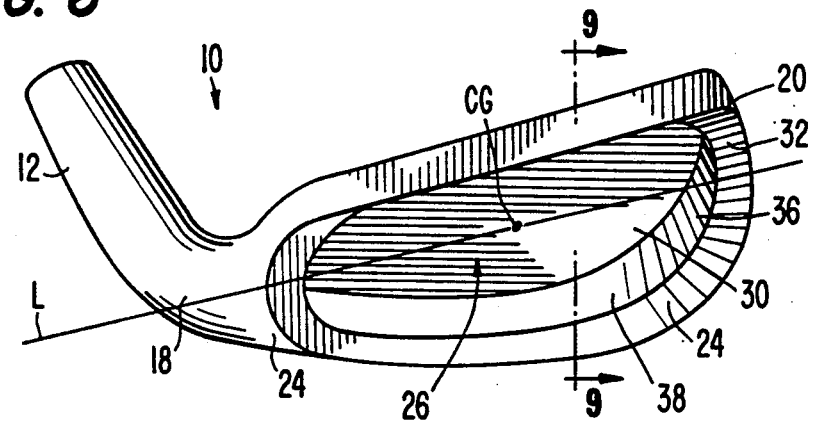
FIG. 6 is a rear elevational view of the club head of FIG. 5.
Figure 7:
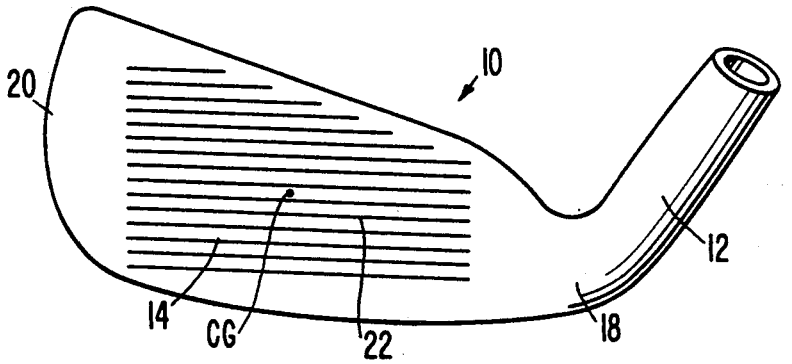
FIG. 7 is a front elevational view of the club head of FIG. 5.
Figure 8:
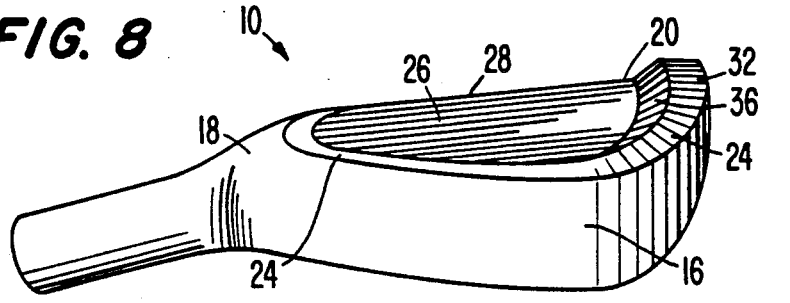
FIG. 8 is a bottom view of the club head of FIG. 5.
Figure 9:
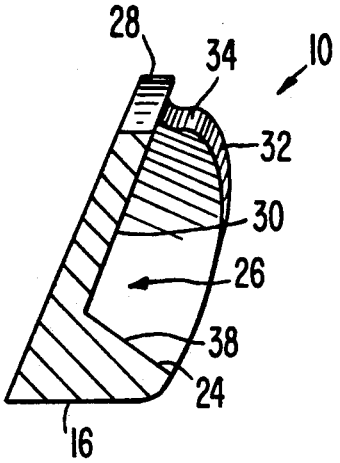
FIG. 9 is a sectional view taken along the lines 9—9 of FIG. 5.
Figure 10:
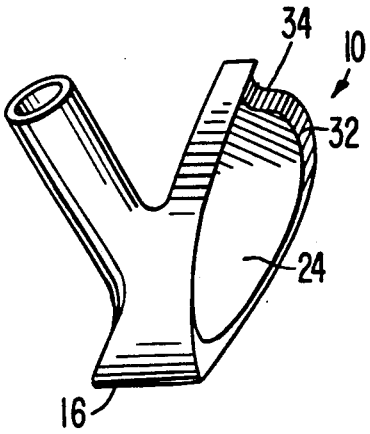
FIG. 10 is an end elevational view of the club head of FIG. 5.
Figure 11:
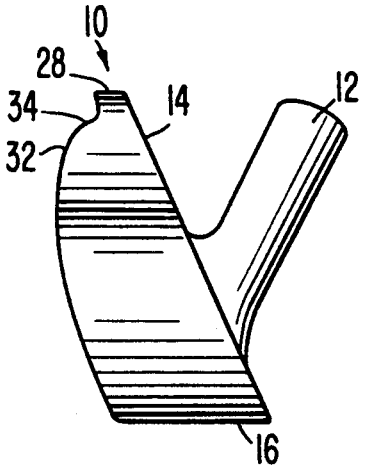
FIG. 11 is an end elevational view taken from the opposite end of FIG. 10.

Before describing applicant's invention, it will be first helpful to reference the prior art clubs shown in FIGS. 1 through 4. Both the forged or full back clubs shown in FIGS. 1 and 2 and the cavity back clubs shown in FIGS. 3 and 4 have a top ridge which extends outwardly and upwardly at a constant diverging angle from the heel portion to the toe portion. Such clubs can be described as high-toe clubs. As shown, both the forged full-back and cavity-back clubs are predominantly weighted at the sole of the club head. As shown in FIGS. 2 and 4, the toe of both clubs has substantially the same end view. The toe has a substantial mass at the sole and progressively decreases in thickness as it extends upwardly to the top ridge. The center of gravity (CG) in such conventional clubs is closer to the sole of the club head than the top ridge, since much of the club head mass is at the club head's sole.

The drawings in FIGS. 5 to 11 illustrate a cast type iron golf club head 10 of the present invention. The club head can have a face loft angle within the range of approximately 16 to 60 degrees. The club head is perimeter weighted, and has a cavity back. The club head 10 includes a hosel portion 12, ball striking face 14, sole portion 16, heel portion 18 and toe portion 20. The ball striking face 14 encompasses the area on the front of the club head which is designed to impact the ball and hit the ball on an intended line of flight perpendicular to the striking face 14. The ball striking face 14 includes a plurality of grooves 22 of conventional design which, when viewed by a golfer, are perpendicular to the normal intended line of flight. The rear of the club head 10 is provided with a perimeter mass 24 which extends along at least the sides and sole of the club head and defines a rear cavity 26. A top ridge 28 extends between the heel 18 and toe 20, and defines the top surface of the club head 10. The mass at the top ridge preferably extends rearwardly of the rear surface 30 and further defines rear cavity 26. The rear face 30 of the club head is, in effect, the bottom of cavity 26. As is apparent in all of the figures of the present invention, the thickness, from striking face to rear, of the club head will vary within the area of the rear cavity. The thickness of the club at this area is preferably within the range of 0.125 to 0.200 inches.

Unlike the prior art shown in FIGS. 1 to 4 with a relatively narrow or thin upper toe portion, the present invention includes an upper toe mass 32 formed in an area adjacent the upper portion of the toe 20 and above the sole 16 of the club head. The mass 32, in effect, is an upward and rearward extension of the peripheral mass 24 in the area adjacent the upper portion of the toe 20.

The club illustrated in FIGS. 5 to 11 has a longitudinal axis L which bisects the striking face and extends through the center of the face of the club head. As can be seen by comparing FIG. 11 with FIGS. 1 and 4, the club head of the present invention has a significantly increased mass above the longitudinal axis L and toward the toe portion. The perimeter weight at the toe portion is formed on the outer periphery of the club head at the toe portion and extends rearwardly from and below the top ridge and well above the sole. The portion of the toe counterweight above the longitudinal axis has an outer contour that bulges immediately away from the striking face of the club head. The toe portion preferably increases in thickness (face to rear) as it extends downwardly to the sole of the club head.

Figure 15:
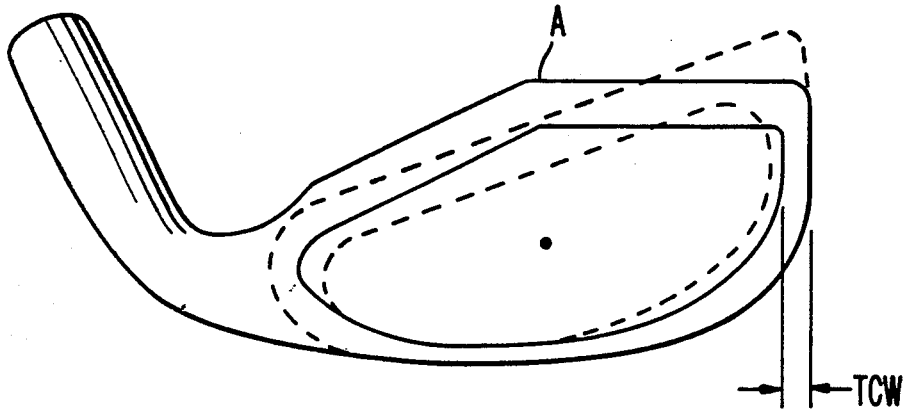
FIG. 15 is a rear view of the club head of FIG. 14.
Figure 16:
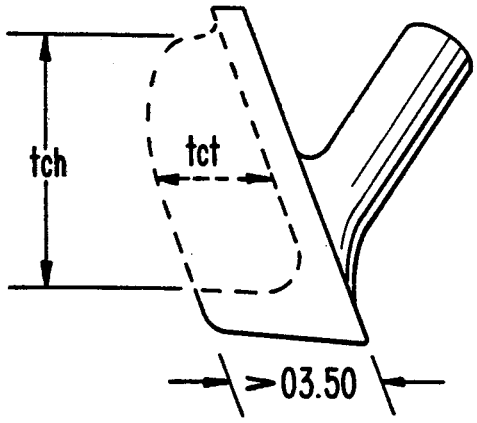
FIG. 16 is an end elevational view of the club head of FIG. 14.
Figure 17:
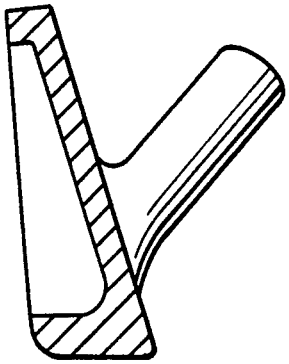
FIG. 17 is a sectional view taken along the lines 17—17 of FIG. 14.
Figure 18:
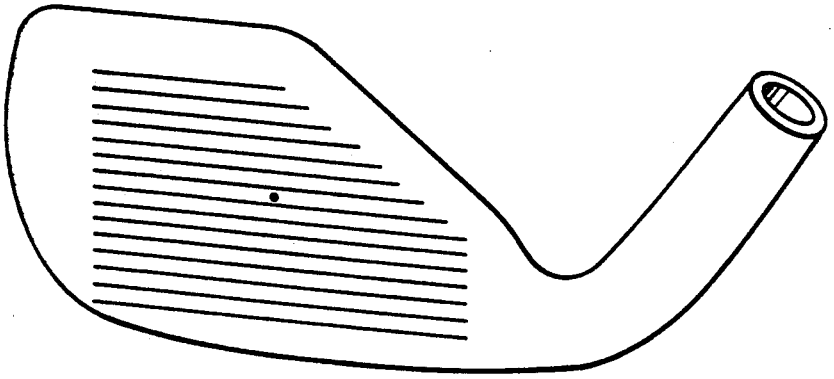
FIG. 18 is a front elevational view of the club head of FIG. 14.

In order to fully define applicant's invention, it is necessary to define certain portions of the club head. For the purposes of this patent specification, the term "toe counterweight" will be defined as that portion of the club head which forms the perimeter weighting at the toe and extends rearwardly from the plane defined by the rear face of the club head at the rear cavity. The toe counterweight is thus within the dotted lines shown in FIG. 16. The toe counterweight has a height (tch) and a thickness (tct) as shown in FIG. 16. This thickness is measured from the extended plane defined by the rear face of the club head at the rear cavity to the rear surface of the toe counterweight. The toe counterweight also has a width measured from the outer perimeter of the counterweight toward the heel portion of the club head. This width is referenced generally as "tcw" in FIG. 15. In addition, the toe counterweight can be further defined by its thickness, the distance from the striking face of the club head to the rear surface of the toe counterweight. Each of the clubs of the present invention has a toe counterweight having at least 25%, and preferably 33%, of its mass located above the longitudinal axis. In addition, each of the clubs of the present invention has a toe counterweight which, at the longitudinal axis, has a thickness of at least 0.350 inches, and more preferably at least 0.375 inches.

For a particular set of clubs made according to the preferred embodiment of the present invention, the thickness of the toe counterweight at the bisecting longitudinal axis will vary from the long irons to the short irons. This thickness will increase as the number of the club increases. In the preferred embodiment, the toe counterweight extends immediately rearwardly of the rear face of the club head at a point spaced below the top ridge of the club head. In the preferred embodiment, at least 25% and preferably a third of the mass of the toe counterweight is located above the longitudinal axis. The additional mass at the upper toe portion is offset by decreasing the size and mass of the perimeter weighting at the sole.

The mass 32 shifts the center of gravity (CG) of the club head 10 upward and toward the toe. The spacing of the top of the counterweight below the top ridge and the immediate rearward projection of the toe counterweight at this point more closely aligns the center of the toe counterweight with the longitudinal axis of the club head. This weight distribution provides the club head with better weight balance enabling maximum energy transfer particularly to golf balls hit off the center of gravity (CG) on the ball striking face 14 and toward the toe 20, while maintaining the aesthetic designs of the club head integrating the smooth parabolic shape of the mass 32 with the peripheral mass 24.

The top ridge 28 of the club shown in FIGS. 1 to 6 extends rearwardly away from the rear face 30 of the club head. The top ridge has two substantially parallel outer edges. In a preferred embodiment the top ridge has a sufficiently large mass to also raise the center of gravity (CG) of a conventional club head. The portion of the ridge extending beyond the plane defined by the extension of the rear surface at the rear cavity provides an upper counterweight. The combination of the mass of the toe counterweight and the mass of the upper counterweight raises the center of gravity (CG) and places more mass close to and above the point where the ball is contacted. Again, the added mass of the upper counterweight and the toe counterweight is offset by reducing approximately that amount of mass at the sole. These changes raise the center of gravity (CG) of the club head and also allow the club head of the present invention to have a larger cavity in the back of the club head, since the added mass at the toe counterweight and the upper counterweight extends rearwardly, rather than inwardly into the cavity. The resultant club head has an improved balance and an increased "sweet spot" to compensate for off-center hits.

A preferred embodiment of a club head shown in FIGS. 5 through 11 is made of metal or other suitable materials and has general dimensions of overall length and width which are analogous to conventional clubs. The top ridge 28 forms the top wall of the cavity 26. The bottom wall of the cavity 26 is formed by the perimeter weighting at the sole.

Figure 12:
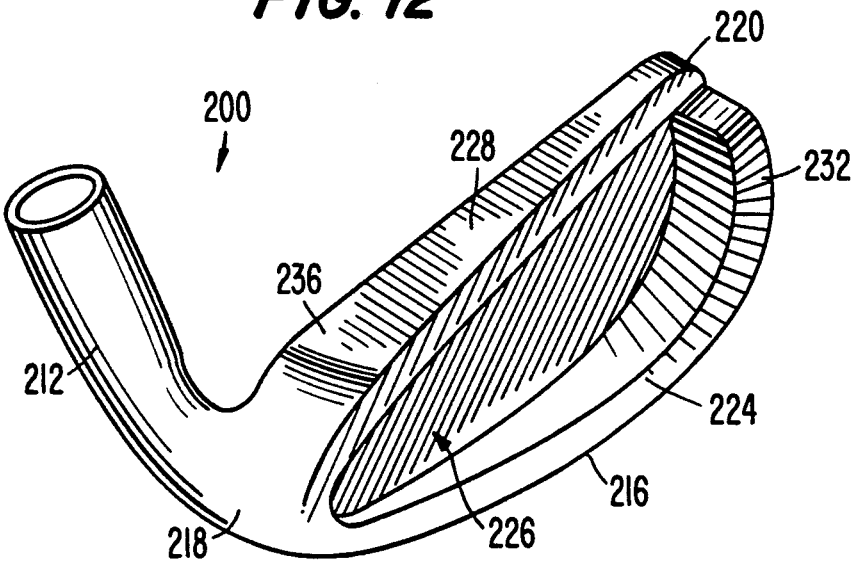
FIG. 12 is a rear perspective view of a second embodiment of the present invention.

FIG. 12 illustrates a second embodiment of the club head 200 of the present invention including a hosel portion 212, bottom portion 216, heel portion 218, toe portion 220, and peripheral mass 224 which forms a rear cavity 226. In this embodiment, the top ridge 228 is triangular in shape and extends from the toe 220 toward the heel 218 to form an additional mass or weight 236 adjacent the heel which counterbalances the upper toe mass 232 on the opposite side of the club head 200. The top ridge 228 extends rearwardly from the rear face and inclines downwardly from the toe 220 to the hosel 212. The thickness of the top ridge 228 progressively increases from the toe area to the heel area. The other aspects of the perimeter weighting of the club are similar to those previously described with reference to FIGS. 5 to 11.

Figure 13:
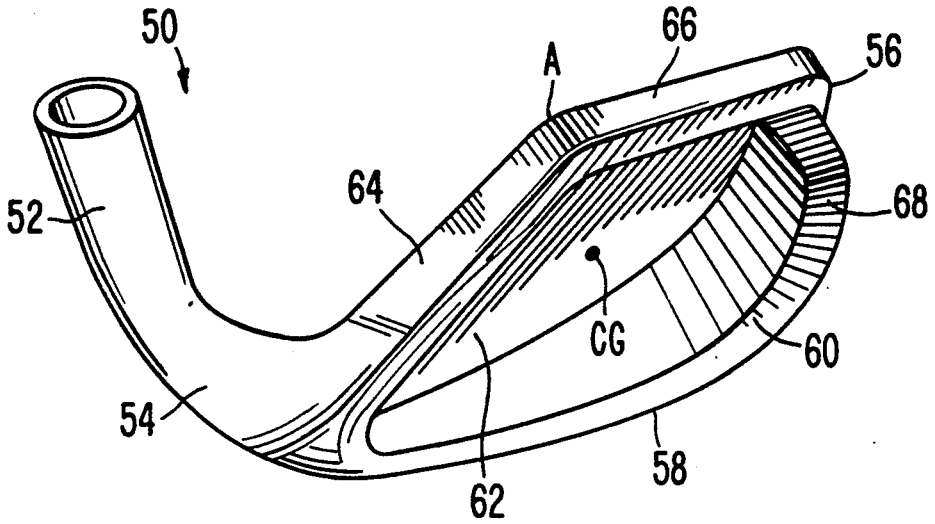
FIG. 13 is a rear perspective view of a third embodiment of the present invention.

FIG. 13 illustrates a third embodiment of a club head 50 of the present invention including a hosel portion 52, a heel portion 54, toe portion 56, bottom portion 58 and a peripheral mass 60 which forms a rear cavity 62. In this embodiment, the top ridge 64 includes a sighting and alignment section 66 which is perpendicular to the intended line of flight of a golf club struck by the club head 50. This sighting and alignment section 66 is formed as part of the top ridge 64 and extends from the toe to a point located between the toe and the hosel. At that point, the top ridge 64 changes direction and extends downwardly toward and into the hosel of the club head. The sighting section 66 is substantially parallel to the face and face grooves of the club head and has a constant height so that the sighting section is substantially horizontal to the ground when the club head is addressed to the ball.

In the preferred embodiment, point A of the club shown in FIG. 13 is located directly above the center of gravity (CG) of the club head. The break in direction at point A is clearly visible and serves as a sighting system to allow a golfer to align the center of the ball with the point A, and thus the center of the club head. The sighting section 66 also allows the golfer to properly align the club face with the intended line of flight.

As shown in FIG. 13, an upper toe mass 68 is integrally formed as part of the perimeter weight at the toe 56 and above the bottom 58 of the club head 50. The mass 68 moves the overall weight of the club head to a position more in line with the center of gravity (CG). This embodiment, as well as all embodiments disclosed in this application, thus has the toe counterweight previously described.

The design of the club head shown in FIG. 13 also significantly increases the size of the cavity of the club head and the sweet spot of the club head for greater tolerance, when it strikes a ball. The distance between the sole of the club head and the top ridge at the alignment and sighting section is substantially the same as that of standard club heads. Because a portion of the top ridge extends substantially horizontal from point A to the toe, the area of cavity below this portion of the top ridge is increased. Similarly, since the mass added to the upper toe portion and the top ridge is also redistributed from the sole mass, the cavity also increases in size at the bottom portion of the club head. In addition, the top ridge extends from the heel to point A at a sharper diverging angle than conventional clubs. As best shown in FIG. 15, the resultant club head has an increased cavity area. The dotted line illustrates the cavity of a conventional No. 4 Iron club, as compared to the solid lines of a No. 4 iron club of the present invention, an actual size comparison.

Figure 14:
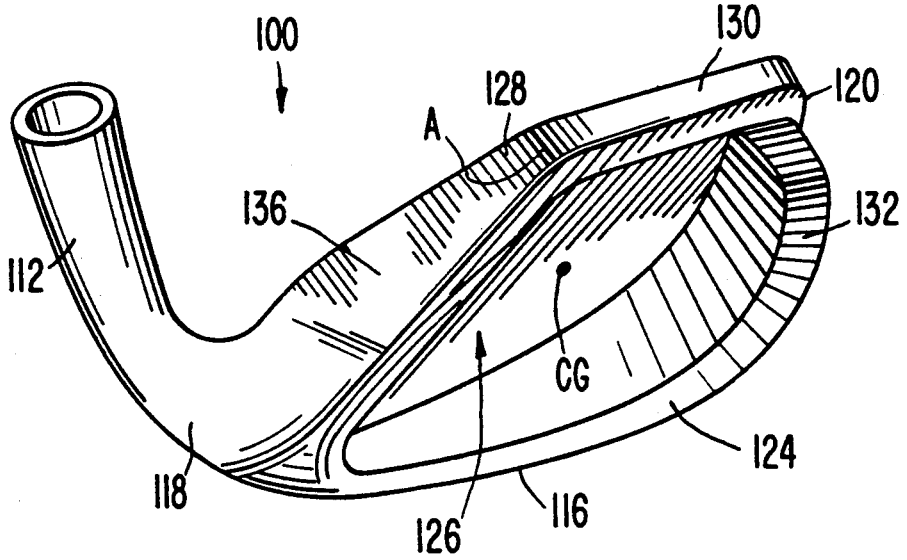
FIG. 14 is a rear perspective view of a fourth embodiment of the present invention.

FIG. 14 illustrates a fourth preferred embodiment of the club head 100 of the present invention including a hosel portion 112, bottom portion 116, heel portion 118, toe portion 120, and peripheral mass 124 which forms a rear cavity 126. In this embodiment, the top ridge 128 includes a sighting and aligning section 130 which is perpendicular to the intended line of flight of a golf ball to be struck by the club head. That sighting and alignment section is the same as section 66 previously disclosed with reference to FIG. 13.

An upper toe mass 132 is provided on the peripheral mass 124 at the toe 120 and above the sole 116 of the club head. A heel weight 136 located on the top ridge 128 of the club head 100 is included in the embodiment of FIG. 14. As shown, the top ridge from point A toward the hosel is substantially triangular in shape and increases in vertical cross sectional thickness as it extends toward the heel. As a result the top ridge is heavier at the heel of the club head, and the resultant heel weight counter balances the opposing weight distribution of the upper toe counterweight 132 on the opposite side of the club head 100. Hence, more club head weight is closer to the center of gravity (CG) and above the point where the club head will generally contact the ball. This improved weight distribution provides increased feel and improved control when a golfer is executing a proper golf shot. In this preferred embodiment, the toe counterweight is formed symmetrically about the longitudinal axis on the club head to further maximize the improved weight relationship of the club head.

Aspects of the preferred embodiments shown in FIG. 14 are illustrated in FIGS. 15 through 18. The club heads are preferably designed so that the center of gravity (CG) of the club head is located approximately at the center of the club face. The triangular top ridge, the toe counterweight and the sole perimeter weighting are properly sized to achieve this result. The sighting and alignment portion of the top ridge is parallel to the club face and perpendicular to the intended line of flight. That portion preferably has a length of at least 1.25 inches. The toe counterweight extends immediately rearwardly from the club head at a point below the top ridge and above the longitudinal axis of the club head.

It should be apparent that the club heads of the present invention are to be included in a complete set of irons. A preferred set of club heads according to the present invention have blade length of approximately 3.05 inches for each club head. The toe height of the club heads ranges from approximately 1.8 inch for a number 1 iron to 2.1 inch for a sand wedge. The finished head weights range from approximately 234 grams for the number 1 iron to approximately 293 grams for the sand wedge.

It will be apparent to those skilled in the art that various modifications and variations may be made in the club head design described above without departing from the scope or spirit of the present invention as defined in the following claims.

I claim:

1. In a perimeter weighted iron type golf club head including a hosel, a heel portion, toe portion, a sole portion a striking face to hit a ball along an intended line of flight, a top ridge, a longitudinal axis bisecting the striking face, a peripheral mass projecting rearwardly from said golf club head and forming a cavity including a rear face defining a bottom of said cavity and located behind said striking face, wherein the improvement comprises:

a toe counterweight having an upper portion formed as an upper and rearward extension of said peripheral mass and located generally adjacent an upper toe portion of said club head, said toe counterweight formed rearwardly from a plane defined by said rear face at said rear cavity and located below said top ridge said toe counterweight having a rear surface;

said toe counterweight having a rearwardly extending, downwardly sloping, parabolic surface, a lower portion of which is integrally formed with said peripheral mass adjacent a lower toe portion of said club head;

said toe counterweight bulging immediately away from said rear face at said upper toe portion and having a substantial portion of its mass located above said longitudinal axis of said club head.

2. The perimeter weighted club head of claim 1 wherein the rear surface of the toe counterweight at its upper portion above the longitudinal axis is at least 0.350 inches from the club head's striking face.

3. The perimeter weighted golf club head of claim 1 wherein the rear surface of the toe counterweight at its upper portion at the longitudinal axis is about 0.375 inches from the club head's striking face.

4. The perimeter weighted club head of claim 3 wherein the parabolic surface of said toe counterweight is smooth from the top of the toe counterweight to the bottom and wherein the toe counterweight smoothly flow into the sole portion.

5. The perimeter weighted club head of claim 1 wherein said top ridge increases in mass as it extends toward said heel, the increased mass serving to balance said toe counterweight.

6. The perimeter weighted club head of claim 1 further comprising a sighting and aligning section formed on said top ridge and extending in a direction perpendicular to the intended line of flight to facilitate proper club head alignment.

7. The golf club head of claim 6 wherein said top ridge and said toe counterweight are sized to form a balanced weight system on opposite sides of the center of gravity (CG) of the club head.

8. The perimeter weighted club head of claim 1 wherein the toe counterweight has a thickness measured from the striking face to said rear surface of at least 0.350 inches.

* * * * *